US010279941B2

(12) United States Patent
Hansen

(10) Patent No.: US 10,279,941 B2
(45) Date of Patent: May 7, 2019

(54) METHOD OF ERECTING A CASE

(71) Applicant: BOXEM APS, Fredericia (DK)

(72) Inventor: Ole Hansen, Gudbjerg Sydfyn (DK)

(73) Assignee: BoxEM ApS (DK)

( * ) Notice: Subject to any disclaimer, the term of this patent is extended or adjusted under 35 U.S.C. 154(b) by 485 days.

(21) Appl. No.: 15/022,472

(22) PCT Filed: Sep. 18, 2014

(86) PCT No.: PCT/DK2014/050293
§ 371 (c)(1),
(2) Date: Mar. 16, 2016

(87) PCT Pub. No.: WO2015/039669
PCT Pub. Date: Mar. 26, 2015

(65) Prior Publication Data

US 2016/0229571 A1 Aug. 11, 2016

(30) Foreign Application Priority Data

Sep. 18, 2013 (DK) ..... 2013 70522

(51) Int. Cl.
*B65B 43/28* (2006.01)
*B31B 50/78* (2017.01)
(Continued)

(52) U.S. Cl.
CPC ..... *B65B 43/285* (2013.01); *B31B 50/005* (2017.08); *B31B 50/0044* (2017.08);
(Continued)

(58) Field of Classification Search
CPC ..... B65B 43/26; B65B 43/265; B65B 43/285; B65B 7/20; B31B 50/005; B31B 50/07;
(Continued)

(56) References Cited

U.S. PATENT DOCUMENTS 3,808,770 A * 5/1974 Berney ..... B65B 7/20 53/284
3,846,962 A * 11/1974 Rossi ..... B65B 5/06 493/130

(Continued)

FOREIGN PATENT DOCUMENTS

EP 0025547 A1 3/1981
EP 2017177 A1 1/2009
WO WO 2013/125956 A1 8/2013

*Primary Examiner* — Gloria R Weeks
*Assistant Examiner* — Dariush Seif
(74) *Attorney, Agent, or Firm* — Condo Roccia Koptiw LLP

(57) ABSTRACT

By the method, a case having four sidewalls and at least four flaps at the bottom of the case is erected from a blank in a number of steps. The automated case erecting unit for use in erecting case blanks comprises a supporting device (9) and a picking and handling device (2), said picking and handling device being a robot with a robotic arm, wherein said robotic arm comprising a picking member (3) with a first leg and a second leg, which are placed perpendicularly and are locked in relation to each other, each leg comprising gripping means for picking up case blanks.

7 Claims, 8 Drawing Sheets

Figure 1:
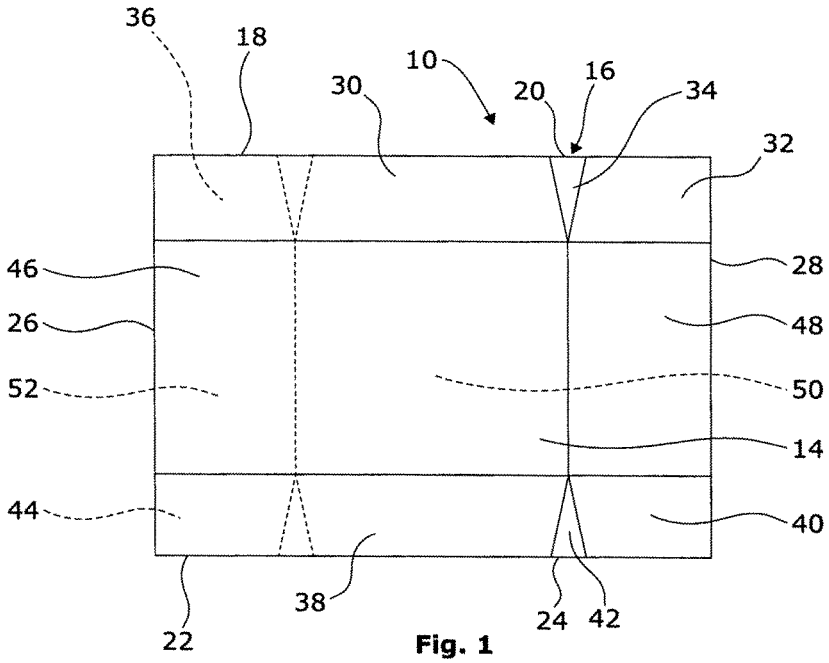

(51) Int. Cl.

| | |
|---|---|
| ***B31B 50/52*** | (2017.01) |
| ***B31B 50/07*** | (2017.01) |
| ***B31B 50/00*** | (2017.01) |
| *B31B 50/62* | (2017.01) |
| *B31B 50/06* | (2017.01) |
| *B31B 50/72* | (2017.01) |
| *B31B 120/30* | (2017.01) |
| *B31B 110/35* | (2017.01) |
| *B31B 100/00* | (2017.01) |

(52) U.S. Cl.
CPC ..... *B31B 50/07* (2017.08); *B31B 50/52* (2017.08); *B31B 50/78* (2017.08); *B31B 50/782* (2017.08); *B31B 50/066* (2017.08); *B31B 50/62* (2017.08); *B31B 50/722* (2017.08); *B31B 2100/002* (2017.08); *B31B 2110/35* (2017.08); *B31B 2120/302* (2017.08)

(58) Field of Classification Search
CPC ... B31B 50/78; B31B 50/0044; B31B 50/782; B31B 50/52; B31B 50/066; B31B 50/62; B31B 50/722; B31B 2105/0024; B31B 2105/0025; B31B 2105/27; B31B 2100/002; B31B 2120/00; B31B 2120/30; B31B 2120/302; B31B 2110/35
USPC ..... 53/457, 458, 564, 381.1, 387.1, 387.2, 53/491, 390, 376.4, 376.7, 376.8; 493/183, 70, 80, 245, 260, 261, 309, 311, 493/312, 316, 318, 319
See application file for complete search history.

(56) References Cited

U.S. PATENT DOCUMENTS

| | | | | | |
|---|---|---|---|---|---|
| 4,031,817 | A * | 6/1977 | Raschke | B31B 50/00 | 493/164 |
| 4,224,781 | A | 9/1980 | Salenbo | | |
| 4,570,421 | A * | 2/1986 | Focke | B65B 7/20 | 493/177 |
| 4,936,816 | A * | 6/1990 | Blumle | B65B 43/39 | 414/411 |
| 5,042,233 | A * | 8/1991 | Huang | B65B 5/061 | 53/242 |
| 5,115,625 | A * | 5/1992 | Barbulesco | B65B 5/024 | 53/242 |
| 5,372,569 | A * | 12/1994 | Ballos, III | B65B 43/265 | 414/789.9 |
| 5,782,064 | A * | 7/1998 | Beeman | B65B 7/20 | 53/377.2 |
| 6,306,070 | B1 * | 10/2001 | Herrin | B31B 50/00 | 493/125 |
| 2006/0117714 | A1 * | 6/2006 | Draghetti | B65B 5/024 | 53/458 |
| 2011/0030318 | A1 * | 2/2011 | Moylan | B65B 5/04 | 53/458 |
| 2013/0036716 | A1 * | 2/2013 | Tsutsumi | B65B 43/305 | 53/564 |
| 2014/0179501 | A1 * | 6/2014 | Akama | B25J 9/0096 | 493/162 |
| 2015/0087491 | A1 * | 3/2015 | Langen | B65B 43/305 | 493/162 |

* cited by examiner

METHOD OF ERECTING A CASE

CROSS REFERENCE TO RELATED APPLICATIONS

This application is the National Stage Entry under 35U.S.C. § 371of Patent Cooperation Treaty Application No PCT/DK2014/050293, filed Sep. 18, 2014, which claims the benefit of Danish Patent Application No. PA 2013 70522, filed Sep. 18, 2013, the contents of which are hereby incorporated by reference herein.

The present invention relates to an automated case erecting unit and a method of erecting a case from a case blank.

Case erecting units are known and used in many manufacturing and packing environments at manufacturing sites. These case erecting units are typically large and heavy, expensive to purchase and maintain and requires much floor space and can thus be difficult to move.

On this background, it is an object of the invention to provide a method of erecting a case of the kind mentioned in the introduction which enables performing said method with an automated case erecting unit which is compact and thus easier to move. For some embodiments, it is also an object of the invention to provide an automated case erecting unit which is relatively inexpensive to purchase and/or maintain.

In a first aspect, these and other purposes are achieved according to the invention by moving an unflattened case blank downwards so that a first flap is folded towards a first sidewall to form a partially folded case, moving the partially folded case in the longitudinal direction of the supporting device to reach a transversally positioned gap, moving the partially folded case downwards so that a second flap enters the transversally positioned gap, moving the partially folded case in the longitudinal direction of the sup-porting device to fold the second flap towards a second sidewall, moving the partially folded case essentially perpendicularly to the longitudinal direction of the supporting device to fold a third flap towards a third sidewall, moving the partially folded case upwards until a bottom edge of a fourth flap is lifted above the supporting device, and moving the partially folded case essentially perpendicularly to the longitudinal direction of the supporting device to fold a fourth flap towards a fourth sidewall, thereby providing a case in a folded condition.

In this manner, in a simple way, a case is erected and folded using minimal working space, i.e. a very small foot print, compared to known solutions, thus enabling a smaller set-up of a more flexible and/or inexpensive case erecting unit. In itself the small size is an advantage in a production and/or packing environment. Furthermore, the relatively small size of the automated case erecting unit makes it possible to move it around in a production and/or packing area, e.g. between different production and/or packing lines, which yields another advantage. In addition, as the offered solution can be used for erecting cases of many different sizes, the automated case erecting unit and method of erecting a case from a case blank according to the invention provide an overall highly flexible and inexpensive solution, since one unit can be used in multiple positions. In addition, in comparison with known methods, the essentially perpendicular movement causing the third and the fourth flap to be folded is especially well-suited for erecting cases made of certain types of material or having certain properties, for example relatively thick and/or rigid case blank material. In a particular embodiment, during the essentially perpendicular movement to fold the third and fourth flap respectively, the third and fourth flap are manipulated over more than 50% of the length of the flap at the same time.

In one embodiment of the method of the invention, the method further comprises the step of bringing the second panel of the unflattened blank into contact with a stop after the step of moving the unflattened blank upwards thereby causing the blank to assume said unflattened condition, the contact with the stop causing the unflattened blank to assume a substantially rectangular shape. This embodiment provides a simple and inexpensive way of bringing the unflattened blank to assume a substantially rectangular shape compared to known methods. This method is particularly well-suited for certain types of case blanks having certain material properties, e.g. weight or thickness, as cases of these materials and/or properties may not assume a substantially rectangular shape by merely lifting the flattened blank and thus rely only on gravity to bring the unflattened blank to assume a substantially rectangular shape.

In a preferred embodiment of the method of the invention, the blank is lifted simultaneously at two adjacent panels during the step of moving the unflattened blank upwards.

In another embodiment of the method of the invention, the step of moving said unflattened blank downwards so that a first flap is folded towards a first sidewall to form a partially folded case includes a sliding movement in the longitudinal direction of the supporting device. This is done to further facilitate the folding of the first flap.

In one embodiment of the method of the invention, a packing step is performed, so that the case in the folded condition is packed with one or more items.

In a preferred embodiment of the method of the invention, a palletisation step is performed to appropriately place the case in the folded condition on a pallet or similar device.

In a particularly preferred embodiment of the method of the invention, the packing and palletisation steps are performed in one operation.

In a second aspect of the invention, an automated case erecting unit is provided and comprises a supporting device and a picking and handling device, said picking and handling device being a robot with a robotic arm, wherein said robotic arm comprising a picking member with a first leg and a second leg, which are placed perpendicularly and are locked in relation to each other, each leg comprising gripping means for picking up case blanks. This embodiment has the advantage of being very stable in use and inexpensive compared to known solutions having a more complex structure leading to higher purchase price and higher costs related to overhaul and maintenance. The gripping means can be any suited means such as compressed air supply means, mechanical gripping means, adhesive means, magnetic means etc. Compared to known solutions which normally include numerous moving parts, the automated case erecting unit can have relatively few moving parts, which means lower overhaul and maintenance costs.

In one embodiment of the invention, in the picking member of the picking and handling device, only the suction cups are moving parts compared to known solutions comprising pistons and/or motors and the like. Thus, overhaul and maintenance costs are lower, which is an advantage of this embodiment of the invention.

The robot can be a standard robot which is widely commercially available and thus relatively inexpensive compared to custommade robots. This is a further advantage of an embodiment of the invention.

In a preferred embodiment of the invention, the gripping means of the automated case erecting unit comprises at least one suction cup operated by vacuum via first connection means. This provides for a particularly secure engagement between the gripping means and the blank and case.

In a preferred embodiment, more than one suction cup, e.g. two or four suction cups. This can be particularly advantageous certain types of case blanks having certain material properties, e.g. weight, thickness, length or air permeability, as cases of these materials and/or properties may benefit from having more suction cups applied in order to lift the flattened blank. In a particularly preferred embodiment, two suction cups are provided on the first and/or second leg of the picking member.

In an advantageous further development of the preferred embodiment, said suction cup is activated by compressed air supply means via second connection means. This entails that the suction cup or cups are only active when needed for gripping the blank.

In a further preferred embodiment of the invention, each suction cup of the automated case erecting unit has an upper surface which in a first position, before the picking member comes into contact with the case blank, is positioned below the surface of the picking member. This particular embodiment has the advantage of low overhaul and maintenance costs, as tear of the suction cup is minimized by minimizing unnecessary mechanical contact between the suction cup and the blank prior to moving the blank.

In a preferred embodiment of the invention, the upper surface of each suction cup in a second position, when the picking member is in contact with the case, is positioned above the surface of the picking member.

In another preferred embodiment of the invention, the suction cup is driven from the first position to the second position in a piston-like manner by application of compressed air to a chamber in the first and/or the second leg of the picking member.

In one embodiment of the invention, the automated case erecting unit further comprises a stop. This embodiment provides a simple and inexpensive way of bringing the unflattened blank to assume a substantially rectangular shape compared to known units. This embodiment of the invention is particularly well-suited for certain types of case blanks having certain material properties, e.g. weight or thickness, as cases of these materials and/or properties may not easily assume a substantially rectangular shape by merely lifting the flattened blank.

In one embodiment of the invention, the automated case erecting unit further comprises a packing device for packing one or more items in the case in the folded condition.

Further details are described, and further advantages stated, in the description of particular embodiments of the invention.

Figure 2:
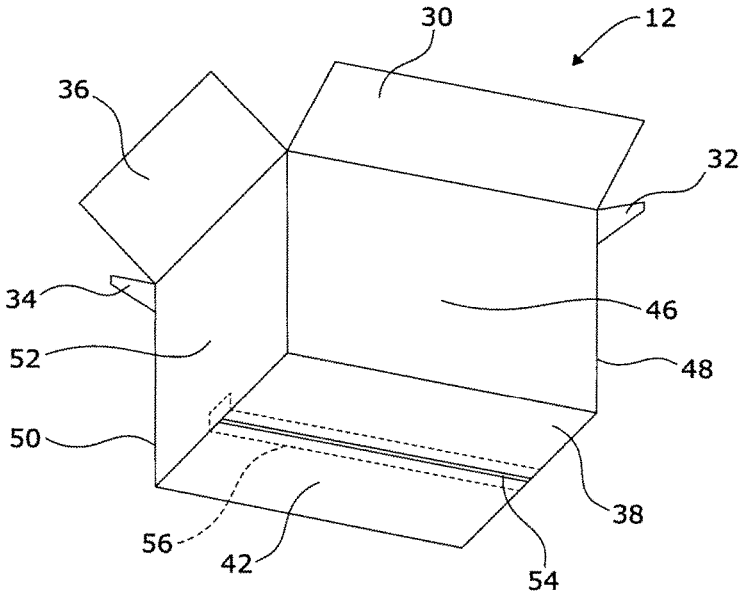
Figure 3:
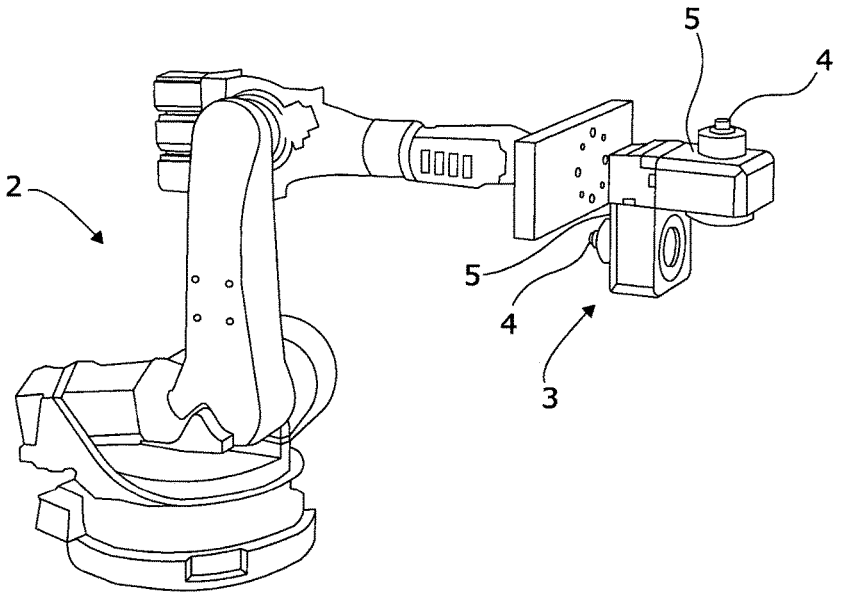
Figure 4:
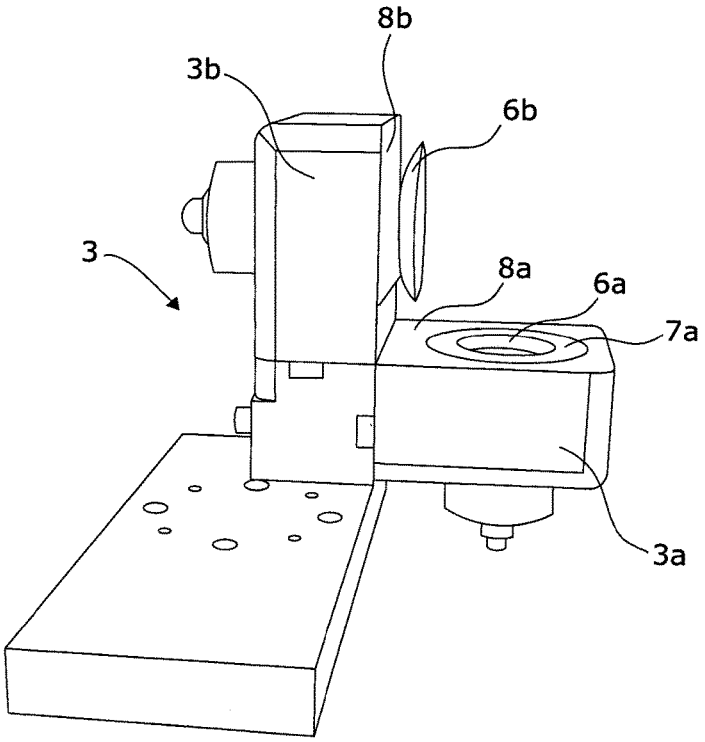
Figure 5:
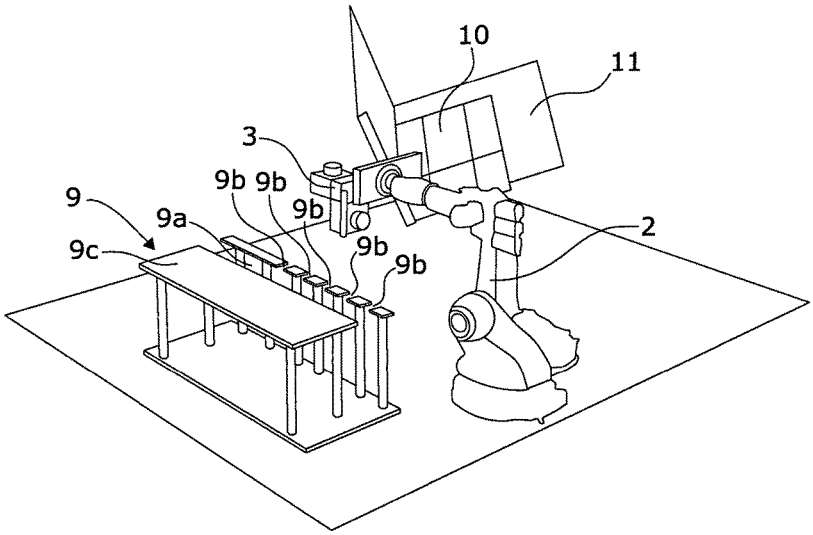
Figure 6:
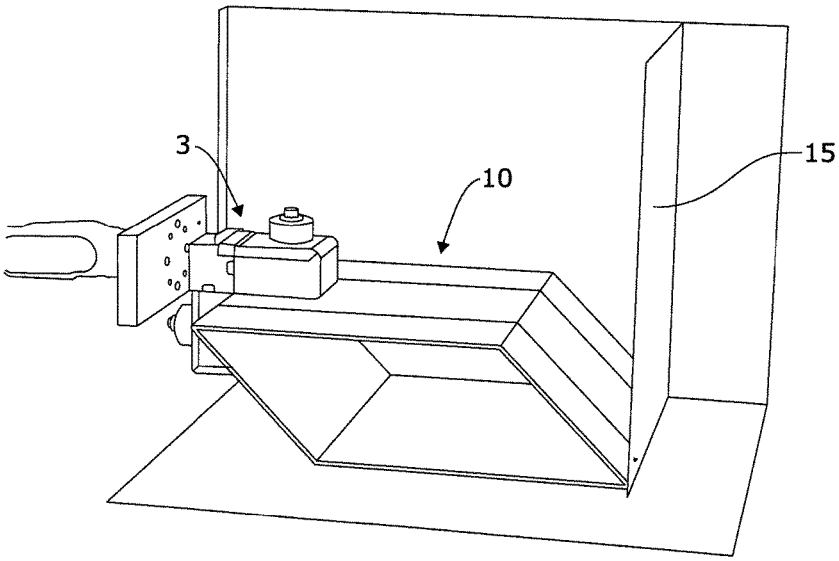
Figure 7:
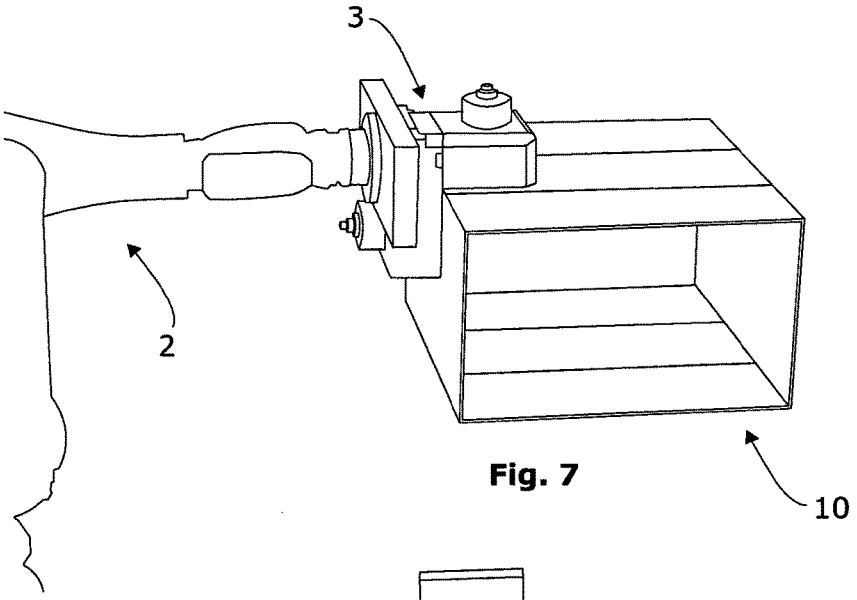
Figure 12:
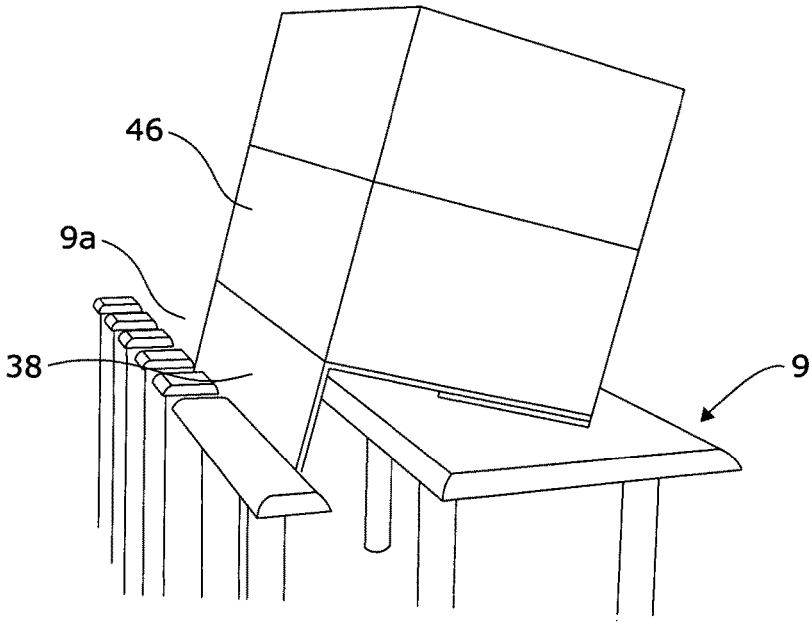
Figure 13:
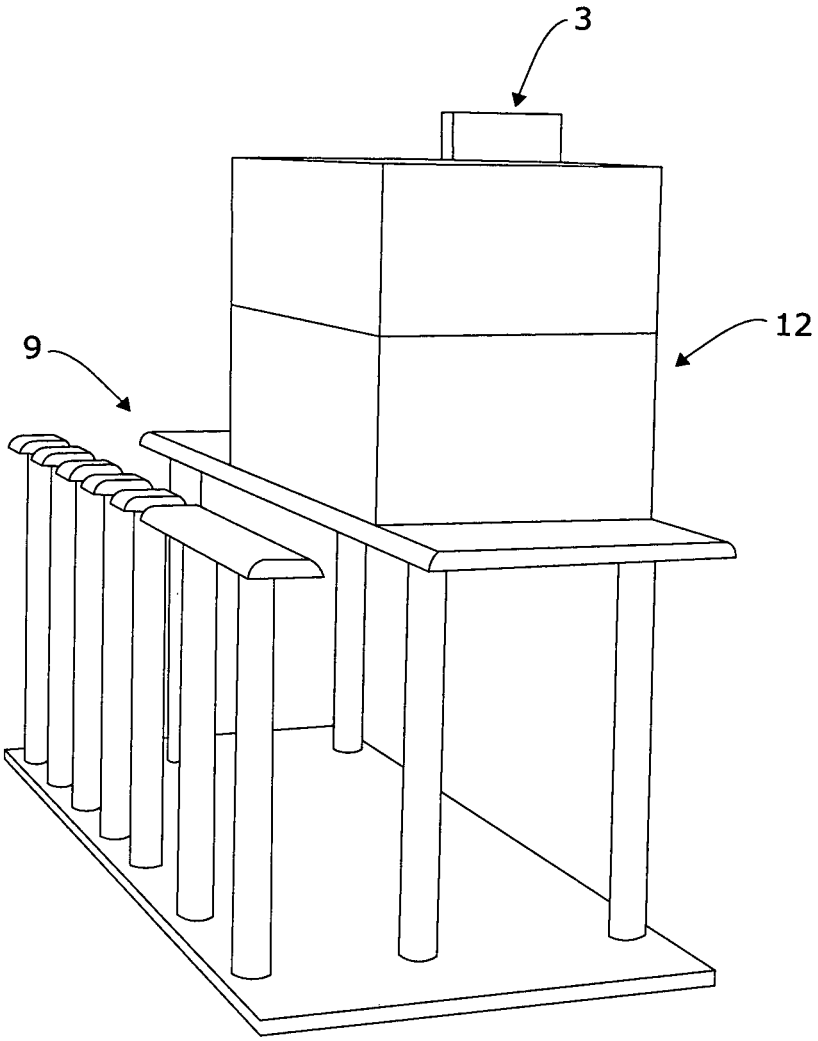
Figure 14:
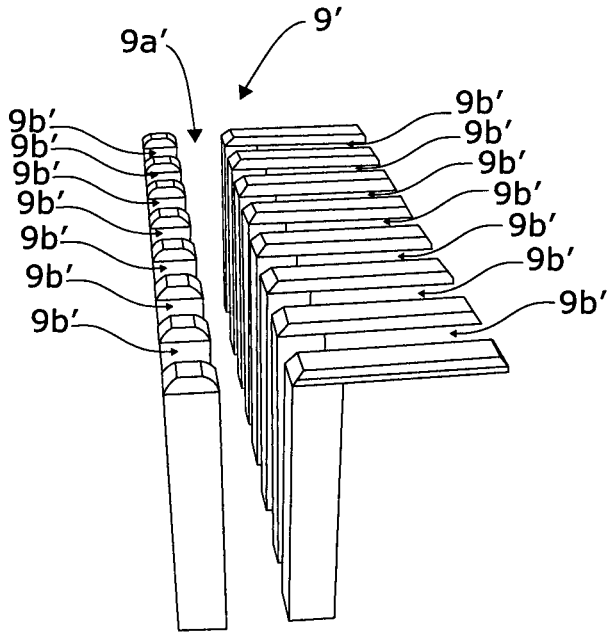
Figure 15:
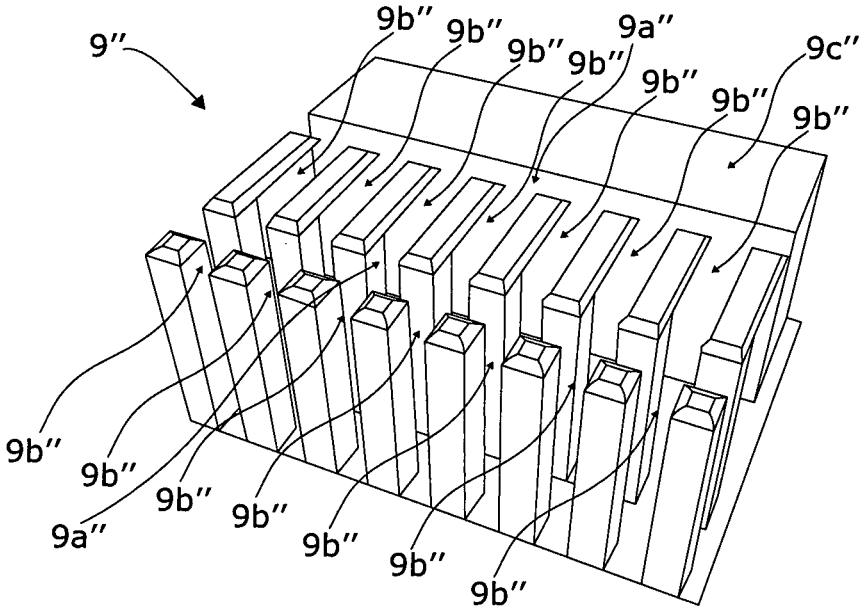

In the following the invention will be described in further detail by means of examples of embodiments with reference to the schematic drawings, in which FIG. 1 is a front view of an embodiment of a case blank, FIG. 2 is a perspective view of a bottom of a case formed from the case blank of FIG. 1, FIG. 3 is a perspective view of an embodiment of a picking and handling device according to the invention, FIG. 4 is a perspective view, on a larger scale, of an embodiment of a picking member of the picking and handling device according to the invention, FIG. 5 is a perspective view of an embodiment of an automated case erecting unit according to the invention, FIG. 6 is a partial, perspective view of another embodiment of the picking and handling member of the automated case erecting unit according to the invention, where the unit includes a stop, FIG. 7 is a partial, perspective view of an embodiment of the automated case erecting unit according to the invention, where the picking and handling device holds an unflattened blank, FIGS. 8-13 show perspective views of an embodiment of the method of erecting a case according to the invention, FIG. 14 is a perspective view of an embodiment of a supporting device of an automated case erecting unit according to the invention, FIG. 15 is a perspective view of an embodiment of a supporting device of an automated case erecting unit according to the invention.

FIG. 1 shows an exemplary case blank 10 in a flat orientation, and FIG. 2 illustrates a case 12 erected from a case blank and bottom sealed. Case blank 10 includes opposite, broad faces 14 and 16, each with a top edge 18, 20 and a bottom edge 22, 24. Side edges 26 and 28 connect the opposite faces 14 and 16. Top edge 18 is formed by top flaps 30 and 32, and top edge 20 is formed by top flaps 34 and 36. Bottom edge 22 is formed by fourth flap 38 and first flap 40, and bottom edge 24 is formed by third flap 42 and second flap 44. The faces 14 and 16 include respective panels 46, 48, 50, 52 that will form the vertical sidewalls of the erected case.

FIG. 2 shows a folded case formed from the case blank of FIG. 1. Panels 46 and 50 will form opposite sidewalls (also numbered 46 and 50) of the erected case 12, and panels 48 and 52 will form the other opposite sidewalls (also numbered 48 and 52) of the erected case. The top and bottom flaps 30, 38 and 34, 42 are associated with and hingedly connected to the sidewalls 46 and 50 and the top and bottom flaps 32, 40 and 36, 44 are associated with and hingedly connected to the sidewalls 48 and 52. As used herein, the term "opposite panels" refer to those pairs of panels 46 and 50, 48 and 52 opposite each other with respect to the erected case 12 and the term "adjacent panels" refer to adjacent panels (e.g. panels 46 and 52) with respect to the erected case. Similarly, the term "opposite flaps" refer to those top and bottom flaps 30 and 34, 38 and 42 associated with and hingedly connected to the opposite panels 46 and 50 and to those top and bottom flaps 32 and 36, 40 and 44 associated with and hingedly connected to the opposite panels 48 and 52. As can be seen in FIG. 2, opposite panels 46 and 50 and their associated bottom flaps 38 and 42 extend substantially parallel to a bottom seam 54 that is sealed by using glue or tape 56 (represented by broken lines). Note that in FIG. 1, the opposite panels 46 and 50, 48 and 52 and opposite flaps 30 and 34, 32 and 36, 38 and 42, 40 and 44 are offset from each other when the case blank is in the flat configuration.

In some embodiments, such as the one shown by FIGS. 1 and 2, panels 46 and 50 are wider than panels 48 and 52. However, in other embodiments, the panels (and flaps) may be all substantially the same width.

In FIG. 3, an embodiment of the picking and handling device 2 is shown. The picking and handling device 2 is here a robot with a robotic arm. The robot can be of different brand, shape and size. The picking and handling device 2 comprises a picking member 3. For simplicity reasons, only parts of the picking member 3 are shown, e.g. first connection means 4 for vacuum and second connection means 5 for compressed air supply means are shown. First connection means 4 provides vacuum allowing the gripping means, in the embodiment shown suction cups 6*a* and 6*b*, to pick up the case blanks. Second connection means 5 provides compressed air from suitable supply means in order to activate the suction cups in a piston-like manner by application of compressed air to a chamber (not shown).

Referring now to FIG. 4, a perspective view of an embodiment of the picking member 3 of the picking and handling device 2 is shown in more detail. The picking member 3 has a first leg 3*a* and a second leg 3*b*, which are placed perpendicularly and are locked in relation to each other. Each leg 3*a*, 3*b* comprises gripping means for picking up case blanks, here shown as suction cups 6*a* and 6*b* operated by vacuum to provide the sucking action via connection means 4 (cf. FIG. 3) and activated by compressed air supply via connection means 5 (cf. FIG. 3). Suction cup 6*a* is shown in a first position, where an upper surface 7*a* of the suction cup 6*a* is positioned slightly below an outer surface 8*a* of the picking member 3. Suction cup 6*b* is shown in a second position, where an upper surface 7*b* of the suction cup 6*b* is positioned above the outer surface 8*b* of the picking member 3. Note that this figure is only exemplary. The first and second positions of suction cups 6*a* and 6*b* may preferably be coordinated so that e.g. both suction cups 6*a* and 6*b* are in the first or second position respectively at the same time. In another embodiment, suction cup 6*a* can be in the first position, while suction cup 6*b* is in the second position or vice versa.

In the embodiment shown, in which each suction cup has an upper surface, the upper surface is able to assume a first position, before the picking member comes into contact with the case blank, in which it is positioned below an outer surface of the picking member.

The upper surface of each suction cup is, in the embodiment shown, able to assume a second position, when the picking member is in contact with the case, and in which it is positioned above the outer surface of the picking member.

The suction cup 6*a*, 6*b* is driven from the first position to the second position in a piston-like manner by application of compressed air to a chamber (not shown) in the first and/or the second leg 3*a*, 3*b* of the picking member 3.

FIG. 5 shows an embodiment of the automated case erecting unit. A supporting device 9, a blank storage 11, a case blank 10, and the picking and handling device 2 are shown. The supporting device 9 has a gap 9*a* positioned in the longitudinal direction of the supporting device to accommodate unfolded flaps during the folding process. In addition, the supporting device 9 has at least one transversally positioned gap, here shown as five transversally positioned gaps 9*b*. The blank storage 11 can be positioned at any suitable place in relation to the picking and handling device 2. Furthermore, the blank storage 11 may be placed horizontally or it may be tilted as shown in this figure.

Referring now to FIG. 6, one exemplary embodiment of the automated case erecting unit is partially shown. In this embodiment, the case erecting device 2 further comprises a stop 15 causing the unflattened blank to assume a substantially rectangular shape. The stop 15 can be placed in any suitable position in relation to the picking and handling device and/or the blank storage. For example, it can be placed vertically as shown in FIG. 6, or it can be placed above and/or offset in relation to the supporting device 9 and in an acute angle in relation to an upper surface 9*c* of the supporting device 9. Other means may be present to assist the folding without departing from the principle underlying the invention of having the picking and handling device perform the folding with the assistance of the supporting device. Referring in particular to FIGS. 7 to 13, the operation of the automated case erecting unit will be described in further detail. In principle, a case is erected from a blank in a number of subsequent steps. FIG. 7 shows the picking and holding device 2 holding the unflattened blank 10 prior to folding.

The bottom flaps 38, 40, 42, 44 are referred to according to the order of folding according to the invention, namely a first flap 40, a second flap 44, a third flap 42, and a fourth flap 38.

Figure 8:
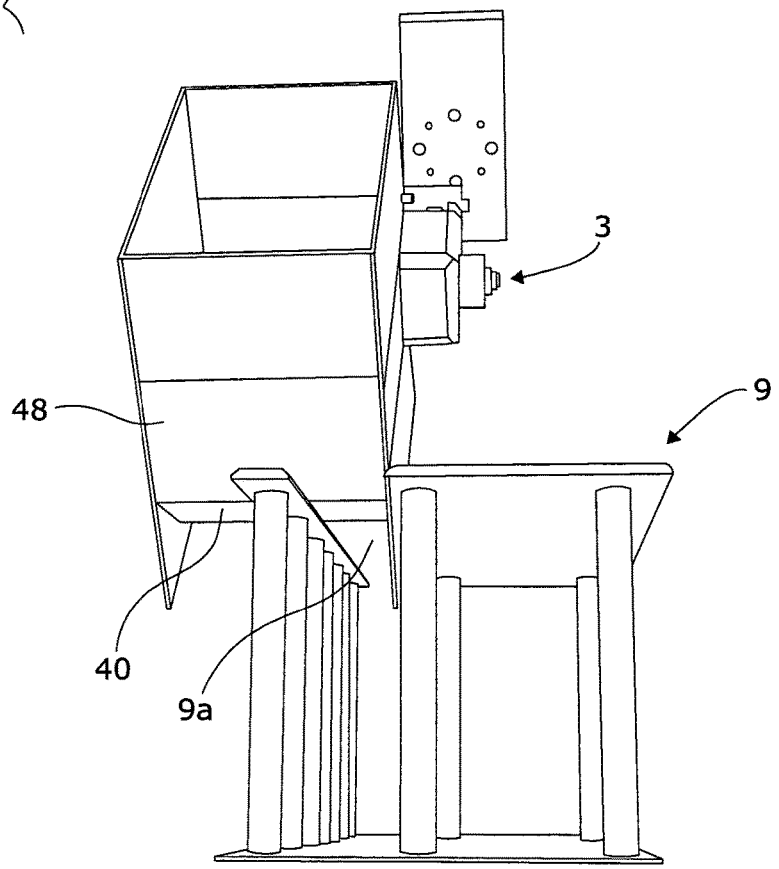

FIG. 8 shows the folding of the first flap 40, where the picking member 3 of the picking and handling device 2 (not shown) moves the unflattened blank 10 downwards so that the first flap 40 is folded towards a first sidewall 48 to form a partially folded case.

Figure 9:
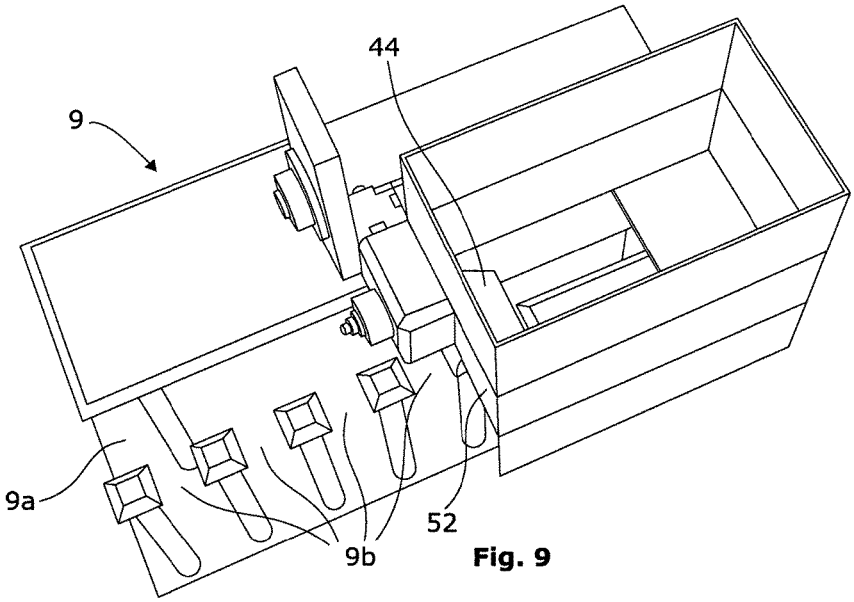

After the step shown in FIG. 8 and prior to what is shown in FIG. 9, the picking member 3 of the picking and handling device 2 moves the partially folded case in the longitudinal direction of the supporting device 9 to reach the transversally positioned gap and subsequently moves the partially folded case downwards so that the second flap 44 enters the transversally positioned gap 9*b*.

FIG. 9 shows the folding of the second flap 44, where the picking member 3 of the picking and handling device 2 (not shown) moves the partially folded case in the longitudinal direction of the supporting device 9 to fold the second flap 44 towards a second sidewall 52.

Figure 10:
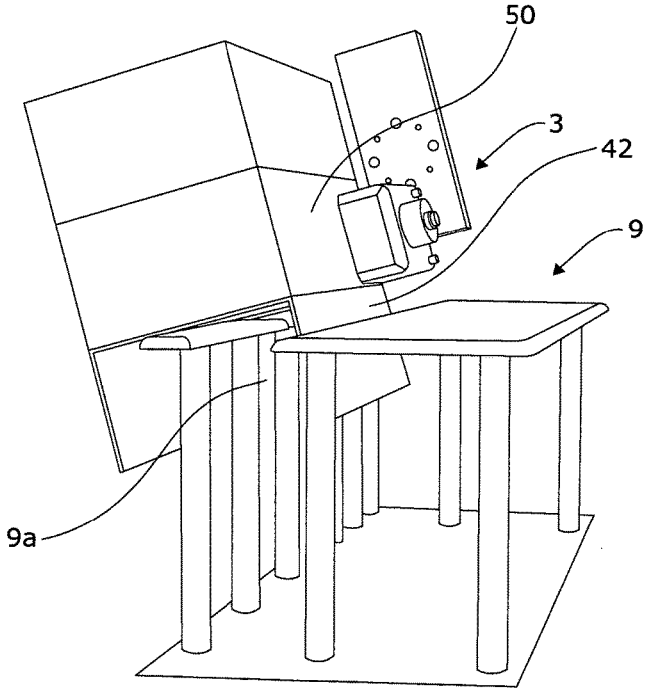

FIG. 10 shows the picking member 3 of the picking and handling device 2 (not shown) and the partially folded case just before folding of the third flap 42. The picking member 3 then moves the partially folded case essentially perpendicularly to the longitudinal direction of the supporting device 9 to fold the third flap 42 towards a third sidewall 50.

Figure 11:
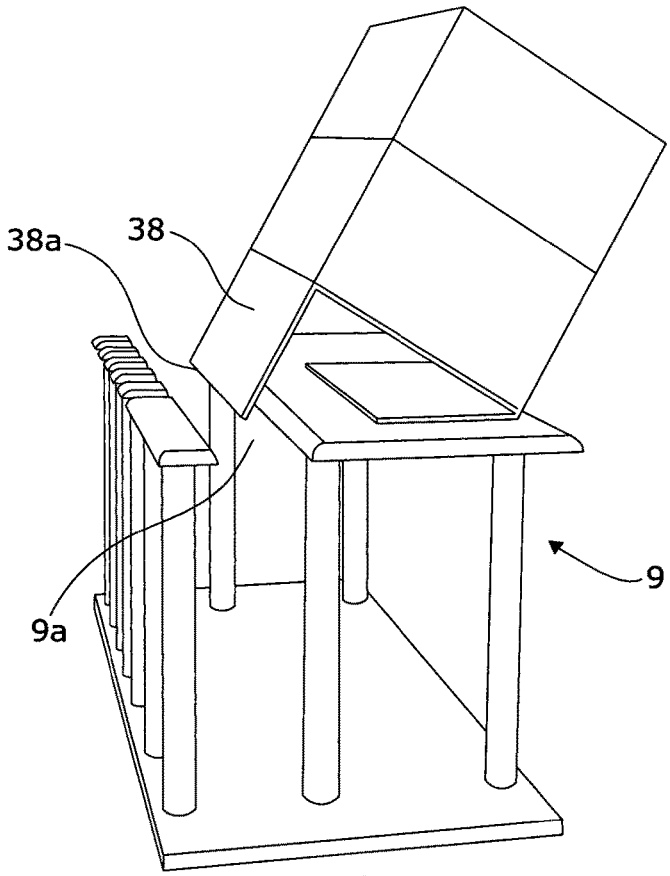

FIG. 11 shows how the partially folded case is moved upwards until a bottom edge 38*a* of the fourth flap 38 is lifted above the supporting device 9 prior to folding the fourth flap 38.

After the step shown in FIG. 11 and prior to what is shown in FIG. 12, one embodiment of the invention includes a step of moving the partially folded case downwards so that the fourth flap 38 enters the longitudinally positioned gap 9*a*.

FIG. 12 shows the picking member 3 of the picking and handling device 2 (not shown) and the partially folded case just before folding of the fourth flap 38. The picking member 3 then moves the partially folded case essentially perpendicularly to the longitudinal direction of the supporting device 9 to fold the fourth flap 38 towards a fourth sidewall 46, thereby providing a case in a folded condition, which is shown in FIG. 13.

FIG. 14 shows an embodiment of a supporting device of the automated case erecting unit. The supporting device 9' is shown. The supporting device 9' has a gap 9*a'* positioned in the longitudinal direction of the supporting device to accommodate unfolded flaps during the folding process. In addition, the supporting device 9' has at least one transversally positioned gap, here shown as two sets of seven transversally positioned gaps 9*b'*.

FIG. 15 shows an embodiment of a supporting device of the automated case erecting unit. The supporting device 9" is shown. The supporting device 9" has two gaps 9*a"* positioned in the longitudinal direction of the supporting device to accommodate unfolded flaps during the folding process. In addition, the supporting device 9" has at least one transversally positioned gap, here shown as two sets of seven transversally positioned gaps 9*b"*. In addition, the supporting device 9" comprises a substantially planar, uninterrupted surface 9*c"* which adds to the flexible performance of the invention in that e.g. the folding of the unflattened blank can be done in more different positions by using different combinations of the transversally positioned gaps 9*b*" and gaps 9*a*" positioned in the longitudinal direction of the supporting device to accommodate unfolded flaps during the folding process.

It is understood that any embodiment of the supporting device of the automated case erecting unit of the invention shown in the figures can serve as a supporting device when packing the case in the folded condition with one or more items.

The invention claimed is:

1. A method of erecting a case having four sidewalls and at least four flaps, the method comprising:

picking a blank in a flattened condition from a blank storage with a picking and handling device, the blank comprising four panels and at least four flaps;

moving the blank upwards causing the blank to assume an unflattened condition;

moving the unflattened blank to a supporting device, the supporting device comprising at least one transversally positioned gap and at least one gap positioned in the longitudinal direction of the supporting device;

moving the unflattened blank downwards such that a first flap is folded towards a first sidewall to form a partially folded case;

moving the partially folded case in the longitudinal direction of the supporting device to reach the transversally positioned gap;

moving the partially folded case downwards such that a second flap enters the transversally positioned gap;

moving the partially folded case in the longitudinal direction of the supporting device to fold the second flap towards a second sidewall;

moving the partially folded case substantially perpendicularly to the longitudinal direction of the supporting device to fold a third flap towards a third sidewall;

moving the partially folded case upwards until a bottom edge of a fourth flap is lifted above the supporting device; and moving the partially folded case substantially perpendicularly to the longitudinal direction of the supporting device to fold a fourth flap towards a fourth sidewall, thereby providing a case in a folded condition.

2. The method according to claim 1, further comprising:

bringing the second panel of the unflattened blank into contact with a stop after the blank is in the unflattened condition, wherein the contact with the stop results in the unflattened blank assuming a substantially rectangular shape.

3. The method according to claim 1, wherein the blank is moved upward by lifting the blank substantially simultaneously at two adjacent panels.

4. The method according to claim 1, wherein moving the unflattened blank downwards such that the first flap is folded towards the first sidewall comprises a sliding movement in the longitudinal direction of the supporting device.

5. The method according to claim 1, further comprising:

packing the case in the folded condition with one or more items.

6. The method according to claim 5, further comprising:

placing the case on a pallet or a similar device in the folded condition.

7. The method according to claim 6, wherein the packing the case and placing the case on the pallet are performed substantially simultaneously.

* * * * *